US005239979A

United States Patent [19]

Maurice et al.

[11] Patent Number: 5,239,979

[45] Date of Patent: Aug. 31, 1993

[54] RADIANT HEATER

[76] Inventors: Paul E. Maurice, 9 Juniper Rd., Westport Point, Mass. 02791; Robert W. Shofner, 3301 S.W. 4th., Bentonville, Ark. 72712

[21] Appl. No.: 980,558

[22] Filed: Nov. 23, 1992

[51] Int. Cl.[5] ..... F24C 3/02

[52] U.S. Cl. ..... 126/85 A; 126/92 B; 126/91 R; 119/32

[58] Field of Search ..... 126/85 A, 92 R, 92 B, 126/39 R, 39 K, 92 AC, 91 R, 85 R, 92 C, 83; 431/354, 171; 119/32

[56] References Cited

U.S. PATENT DOCUMENTS

| | | | |
|---|---|---|---|
| 1,410,532 | 3/1922 | Molby | 126/85 A |
| 3,027,888 | 4/1962 | DuFault et al. | 126/85 A |
| 3,174,532 | 3/1965 | Ferree | 126/92 B |
| 3,349,752 | 10/1967 | Murphy | 119/32 |
| 3,765,610 | 10/1973 | Schell | 119/32 |
| 4,719,874 | 1/1988 | Maurice | 126/92 B |

*Primary Examiner*—James C. Yeung
*Attorney, Agent, or Firm*—Morgan & Finnegan

[57] ABSTRACT

An improved radiant heater for use in dusty environments and at low gas pressures. An open throat, single port burner, which is not subject to obstruction in dusty environments, directs combustion products vertically from a lower fuel input end to an upper flame-emanating end. The burner is adjustably mounted to a base unit so that air entrainment into the burner may be controlled by adjusting the distance between the base unit and the burner fuel input end. The burner conductance may be adjusted to operate at varying fuel input fluxes by attaching an area reduction means to the burner. The burner flame emanating end is directed into a combustion chamber which absorbs the heat generated by combustion and radiates the absorbed heat into the ambient. The lower surface of the combustion chamber has an aperture for receiving the burner flame emanating end, and acts as a heat shield. Control components, such as control circuitry and a fuel valve, are housed within the base unit, further shielding them from heat. The base unit is assembled from top housing and bottom cover which are prevented from joining by a spacing means, and the space is sealed by an elastic dust sealing ring. A means is also included which prevents rotation of a fuel input line.

7 Claims, 3 Drawing Sheets

RADIANT HEATER

BACKGROUND AND OBJECTS OF THE INVENTION

1. Field of the Invention

The present invention relates generally to space heaters, and more particularly, to an improved gas-fired radiant space heater for use in broiler houses or turkey barns which includes a burner that permits safe, efficient operation in dusty environments and at low gas pressures.

2. Description of the Prior Art

In grow-out barns for turkeys or broilers, a heating means is often required to maintain a temperature conducive to development of these birds. The heating means must provide sufficient heat for these large barns while operating safely and reliably in the very dusty environment that is present. Several types of space heaters for this purpose are presently available.

One type is a space heater which requires a fan unit to ensure proper combustion. The requirement for a fan unit not only increases the cost of these heaters but also increases the necessary maintenance and concomitantly reduces the reliability and efficiency. Specifically, the fan unit collects dust which reduces the air flux blown by the fan. Reduced air fluence both decreases the circulation of heated air and the combustion efficiency, resulting in reduced heating and potentially hazardous conditions due to partial combustion.

Gas-fired space heaters, which do not require a fan for proper combustion, have also been employed for heating grow-out barns. In order to avoid the need for a fan unit which provides sufficient air circulation for proper combustion, these heaters operate at a lower combustion rate and thus, have a lower heating capacity. As a result, a large number of these low heating capacity (e.g., about 28,000–30,000 B.T.U.) units are required which increases the cost to the grower.

To overcome these problems with low-pressure, gas-fired space heaters, high pressure, gas-fired heaters which use a target-type burner have also been developed. The high input pressure (e.g., 10–20 p.s.i.) ensures proper combustion without the need for a fan while also providing higher heating capacities. High-pressures in a poultry-house environment may be dangerous, and fires have resulted from improper use of this type of heater. Instructions for these heaters indicate that when insufficient heat is produced the grower should increase the gas pressure to increase the gas flow rate and thereby increase heat generation. Further increasing the pressure, however, further increases the safety hazards.

Bunsen-type gas burners which operate at normal pressures have been used in for boilers, furnaces, and other related heating equipment. Typically, these burners have a horizontal venturi with an elbow transition into a vertical single-port burner. This design has also been used in a low heating capacity (e.g., 30,000 B.T.U.) brooder-type device; however, this device was recalled and removed from manufacture because of chronic obstruction by dust in the horizontal venturi and elbow transition.

There are also general purpose space heaters available which do not require fan units, operate at normal pressures, and have sufficient heating capacity. These heaters, however, are not well suited for dusty environments because they typically employ a multi-port Bunsen-type gas burner which is prone to obstruction. Again, burner obstruction leads to incomplete combustion which may result in reduced heating and dangerous operating conditions.

3. Objections of the Invention

Accordingly, an object of the present invention is to provide a gas-fired radiant space heater which will efficiently and safely operate in dusty environments such as that found in turkey barns and broiler houses, and at normal low gas pressures.

A related object of the present invention is to provide a burner which may be safely operated under the described conditions.

Another related object of the present invention is to provide a heater structural design which permits adjustment of the air entrainment into the burner and into the combustion region.

A further related object is to provide an economical, simple structure for sealing the control components from the dusty environment while allowing easy access for maintenance.

Yet another object of the present invention is to provide a heater structural design which avoids controller failure due to excessive temperature caused by the heat generation.

These and other desirable objects are accomplished by the present invention in an economical structure which may be safely operated with little or no personal attention. In the particular embodiment set forth below, a radiant space heater for use by poultry or livestock growers incorporates these objects and advantages and thus, represents an improvement over prior art spacer heaters.

Objects and advantages of the present invention are set forth in part herein and in part will be obvious herefrom, or may be learned by practicing the invention, the same being realized and attained by means of the instrument and combinations pointed out in the appended claims.

The invention consists in the novel parts, constructions, arrangements, combinations, steps and improvements herein shown and described.

SUMMARY OF THE INVENTION

Briefly described, the present invention is directed to an improved gas-fired radiant heater which is particularly designed for use in dusty environments such as that found in poultry houses. In accordance with the preferred embodiment described below, the radiant space heater unit comprises: a base unit for housing control electronics and gas valves; a combustion chamber; and a burner.

The base unit includes a top housing and bottom cover which may be attached to each other with a space between them to allow for machining tolerances. When the base unit is closed, an elastic dust sealing ring is used to encompass the space between the two joined base unit components, thereby providing an economical sealing means which is effective for sealing components made from a metal spinning process. The base unit houses control circuitry for controlling the heater, a solenoid valve responsive to the control circuitry for providing fuel to a fuel output tube which extends vertically through a hole in the top housing and terminates above the base unit as a fuel output orifice.

The burner is mounted onto the base unit over the fuel output orifice at an optimum height for air entrainment into its fuel input end. The burner features an open throat signal-port construction which directs combustion products from the lower fuel input end vertically upto the flame emanating end. The open throat construction not only assists air entrainment but also, the large diameter prevents obstruction by debris which may result in reduced efficiency, possible failure, and safety hazards. Fuel and air mix as they travel upward, vertically through the burner venturi and out at the burner's flame emanating end.

The burner's flame emanating end is directed into an opening in the lower surface of the combustion chamber which is mounted to the base unit with support legs. This lower surface serves as a heat shield, preventing radiant energy from heating the underlying components, particularly the control electronics which are housed below the top surface of the base unit to further isolate them from radiant energy. The opening also assists air flow about the burner's flame emanating end and into the combustion chamber. The flame emanating end is provided with external webbed members which guide the burner into the opening in the lower surface of the combustion chamber. A flame spreader attaches to the flame emanating end of the burner in order to direct the flame towards the heat radiating walls of the combustion chamber, and further optimize the air flow in the flame emanating region. The combustion chamber absorbs the heat generated by the combustion process and radiates the heat into the ambient. Heated air within the combustion chamber flows into the ambient through openings in the combustion chamber walls, thereby further providing heat via convection.

BRIEF DESCRIPTION OF THE DRAWINGS

The invention will be described in greater detail below by way of reference to the accompanying drawings, wherein.

DETAILED DESCRIPTION OF THE PREFERRED EMBODIMENT

Figure 1:
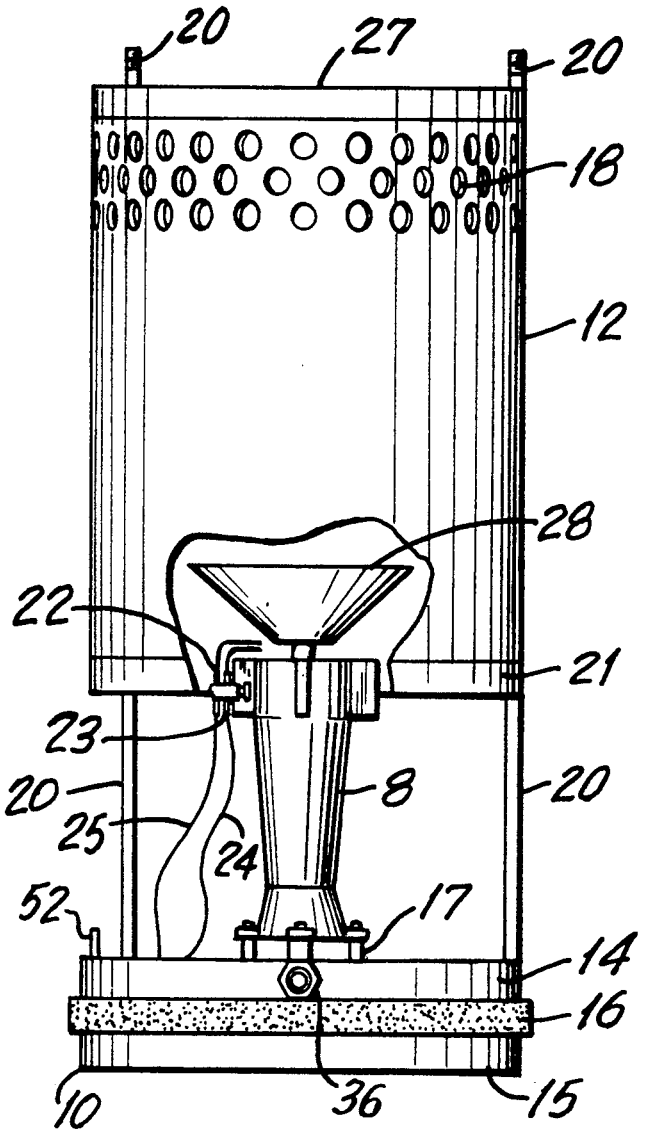
FIG. 1 is an side elevation view with part of the chamber side wall broken away of the radiant heater constructed according to the present invention.

Referring now to the accompanying drawings, wherein like reference characters refer to like parts throughout the various views, FIG. 1 depicts a side view of the radiant space heater in accordance with the present invention. The primary components include base unit 10, burner 8, and combustion chamber 12.

Figure 2:
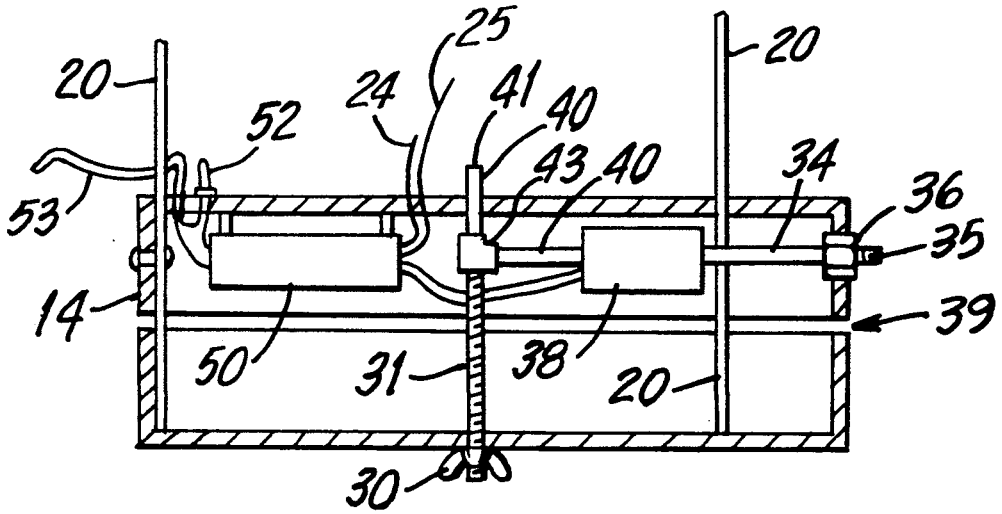
FIG. 2 is a side view of the base unit construction according to the present invention, cut away to show the arrangement of internal components.

Referring to FIGS. 1 and 2, base unit 10 includes a top housing 14 and a bottom cover 15 which are each shallow bucket-shaped members, preferably manufactured from stainless steel using a standard metal spinning process. These spinning processes are typically characterized by relatively large dimensional tolerances, resulting in a diameter variation as well as a variation in the vertical length of the walls along the circumference for these components. Thus, the top housing 14 and bottom cover 15 generally cannot be attached to each other to form a sealed housing which is important to prevent the detrimental effects of dust and debris entering the base unit 10.

The present invention includes a feature to overcome this difficulty. As will be further described below, three leg members 20 (one shown in cutaway view of FIG. 2) pass through slots in the top surface of top housing 14, are attached to the walls thereof, and extend beyond the lower extent of the top housing 14 in order to serve as a vertical stop for bottom cover 15. When the bottom cover 15 is fixed in place by wing nut 30 screwably attached to a bolt 31 which is welded to elbow member 43 and passes through a hole coaxially punched through bottom cover 15, the bottom cover 15 and top housing 14 are prevented from meeting at any point and a space 39 is formed between the two components, even in view of the aforementioned dimensional variations. This space 39 between the top housing 14 and bottom cover 15 is sealed by an elastic dust sealing ring 16 which seals the interior of base unit 10 from any debris or dust.

The cylindrical shaped elastic dust sealing ring 16 is of sufficient axial length to ensure overlapping both the bottom cover 15 and top housing 14, and may be manufactured from any elastic material which has resilient properties and durability. The elastic dust sealing ring 16 is stretched to encompass the joint, and its flexible characteristic and predetermined axial length enables it to form a seal despite the dimensional variations inherent to the spinning manufacture of the top housing 14 and bottom cover 15. Conventional sealing methods, such as using an extruded gasket, or an O-ring would not accommodate the dimensional variance of the spinning process and therefore, are not applicable to sealing such components.

The base unit 10 houses the control electronics as well as the fuel supply components. The fuel supply components include a fuel input tube 34 which enters top housing 14 radially through an aperture provided in the wall of housing 14, and has a pipe thread fitting end 35 for connecting a fuel source such as natural gas or propane, and an opposite end which connects into a solenoid valve assembly 38. The solenoid valve assembly 38 has a fuel output port which is connected to one end of a fuel output tube 40 which includes an elbow member 43 and terminates in a fuel output orifice 41 above the base unit 10. The fuel output orifice 41 end extends upwardly into the lower end of the burner 8.

Preferably, a sleeve member 36, having an inner diameter which closely fits around the outer diameter of the fuel input tube 34 and an outer surface with a non-constant diameter (e.g., hexagonally shaped), is coaxially fitted around the fuel input tube 34. The aperture in the wall of housing 14 through which the fuel input tube 34 passes is shaped to substantially closely fit (e.g., also hexagonally shaped) around the outer hexagonally shaped surface of the sleeve member 36 which is longitudinally positioned therein and tack-welded to the fuel input tube 34. Since the aperture in the wall of housing 14 closely fits around the sleeve member 36, the wall provides a reaction torque to any torque applied to the pipe thread fitting end 35, (e.g., when connecting a fuel source), and thus the applied torque is not transferred to the fuel input tube 34, solenoid valve assembly 38, and fuel output tube 40, thus preventing damage or misalignment of these components. Substantially closely fitting dimension of the aperture with respect to the sleeve member 36, then, is defined by the ability for the sleeve member 36 to fit within the aperture but its inability to rotate therein. This assembly acts as an effective, economical, and easily manufactured means for preventing rotation. Proper alignment of the fuel output tube 40 with respect to the burner 8 is critical for proper, efficient combustion.

Control module 50 is a conventional electronic heater controller for controlling the combustion process, which may include generating appropriate signals for controlling the solenoid valve assembly 38 and the ignition means 22, while receiving a signal from the flame sensing means 23. In the preferred embodiment, the ignition means 22 is part of a spark ignition system while the flame sensing means is part of a flame retification system. Both these systems are well known in the art. In order to limit heat transfer from the top housing 14 to the control module 50, the control module 50 is mounted to the top housing 14 using spacers so that an air gap exists between the control module 50 surface and the top housing 14. The control module 50 is supplied with power from a suitable line source via line 53 and power switch 52.

Figure 3:
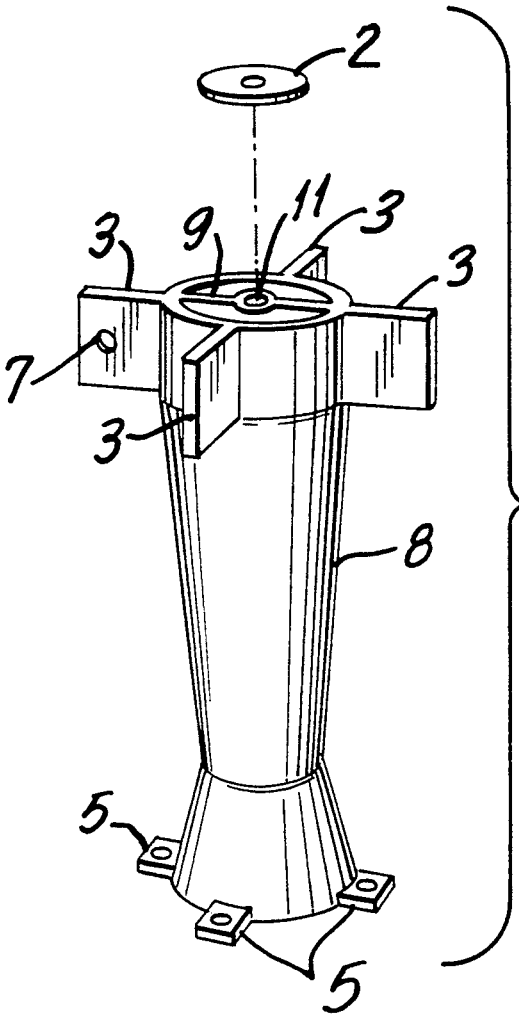
FIG. 3 is a perspective view of the burner, including the area reducing member exploded away from the burner, according to the present invention.

Referring to FIGS. 1 and 3, the overall design of the burner 8 includes a vertical venturi of sufficient length to ensure mixture of the air and fuel. Four tab members 5, (three in view of FIG. 3), each having a bore, are integrally formed equi-angularly around the external surface of the fuel input end of the burner. The interior region of the fuel input end of the burner is an open bore, referred to as an open throat, which extends upwards along the length of the burner. Further, the fuel input end is flared to increase the area for receiving primary air into the burner.

The burner construction also includes four web members 3 which are integrally formed, equiangularly about the external surface of the flame emanating end of the burner 8. One of these members includes a bore 7, for assisting attachment of the ignition means 22 and the flame sensing means 23. The web members 3 serve as guides for centering the burner into the combustion chamber, as will be apparent below, and also provide a larger top surface area for electrical grounding, which increases the reliability of the spark ignition system as well as the flame sensing interlock. The vertical length of the web members 3 is designed to permit adjusting the distance between the base unit 10 and the burner 8, while still guiding the alignment of the burner 8 to the combustion chamber 12.

As shown in FIG. 3, the interior orifice of the flame emanating end may include an integral interior member 9 which has a center axial tap 11 for screwably attaching a flame spreader 28 (FIG. 1). The downward extent of the interior member 9 into the burner throat may be determined by the optimum distance required to prevent deleterious effects upon the combustion process, such as turbulent flow of the air-gas mixture. The entire burner may be cast iron.

Typically, vertical burners of this type have a casting or webbing within the fuel input end of supporting the burner and/or the fuel input orifice, or have a closed fuel input end when attached to the fuel input orifice and have air entrance vents through the lower portion of the burner wall surface. These structures are susceptible to occlusion by dust and do not optimize laminar air entrainment into the burner. The open throat construction of the present invention not only prevents occlusion by dust, but also ensures fluid, laminar entrainment of air into the lower burner end since there are virtually no structural obstructions such as a webbing, and air may enter the burner around the entire periphery of the lower opening. In addition, the open throat construction permits reaming of the interior surface to a smooth finish which further assists the laminar entrainment of air into the burner.

As shown in FIG. 1, the burner is mounted in a fixed position on the base unit 10 and, during manufacture of the radiant heater, is optimally positioned for air entrainment into the lower portion of burner 8. The burner is bolted to the base unit 10 via the bores in tabbed members 5 (FIG. 3) using collars 17 to separate the burner from the base unit 10, which permits adjustment of the burner height by using collars of appropriate length. The funnel-shaped flame spreader 28 preferably includes a threaded stud member which is screwably attached to the burner 8 using center tap 11. The distance of the flame spreader 28 above the flame emanating end of the burner may be predetermined, considering the function of the flame spreader to direct the flame emanating from the burner towards the walls of the combustion chamber 12, concomitantly optimizing air entrainment into the combustion chamber 12 through the aperture in heat shield 21.

The burner design of the present invention is also well suited for ensuring efficient combustion at modified fuel input fluxes from the fuel input orifice into the burner fuel input. This flux may be modified by reducing the area of the fuel output orifice 41 when, for example, reduced heat output from the radiant heater is desired. In order to ensure efficient combustion, the conductance of the burner may be modified by inserting an area reducing member 2 (FIG. 2) at the flame emanating end of the burner 8. This area reducing member 2 is preferably washer-shaped and is coaxially set on the top surface of the burner 8, and is held between this surface and the flame spreader 28 which is attached to the burner 8 using center tap 11. In conjunction with reducing the conductance and the input fuel flow rate, the height of the burner may be adjusted (e.g., lowered) with respect to the base unit by changing the length of the spacers 17, as previously described. Adjusting this distance affects the air flux into the fuel input end of the burner 8, which should be adjusted based on the fuel input and burner conductance in order to optimize combustion.

The combustion chamber 12 is preferably a cylindrical stainless steel shell having a removable closed top cover 27, and a removable bottom heat shield surface 21. The upper portion of the combustion chamber 12 contains openings 18 for effusion of the combustion products. The design of the combustion chamber, including the openings 18, is optimized with respect to the combustion process and considers air entrainment and heat transfer. As described, the heat shield surface has an aperture centered about the cylindrical axis for receiving the flame emanating end of the burner 8.

As shown in FIG. 1, the combustion chamber 12 is attached to the base unit using leg members 20. Preferably, there are three leg members spaced equi-angularly about the cylindrical axis and each extends vertically along the interior walls of the combustion chamber, passing through slots provided in top cover 27, through slots in the heat shield 21, and through slots in the top housing 14. As previously described and shown in FIG. 2, the lower ends of the leg members extend beyond the lower extent of the top housing 14 in order to serve as a lateral guide and vertical stop for bottom cover 15. The upper ends of the leg members extend vertically beyond the top of the combustion chamber and each have a bore, in order to provide a means for attaching a chain-type hanger for suspending the heater while in operation. The leg members are attached to the top housing 14, the combustion chamber 12, the heat shield 21, and the top cover 27.

Under normal operating conditions, power is supplied to the control module 50 using power switch 52. The control module 50 initiates combustion by enabling solenoid valve assembly 38, permitting fuel to flow from the fuel input line 34 to the fuel output orifice 41. Fuel exiting the fuel output orifice 41 enters the burner 8 and mixes with air while traveling vertically towards the flame emanating end, where the fuel is ignited by spark ignitor 22 which is triggered by control module 50. Sustained combustion results in a flame emanating from the burner, which is directed by the flame spreader 28 towards the walls of the combustion chamber 12 causing heating thereof, and the heated walls radiate energy into the ambient. Combustion products and heated air flow through the openings 18 of the combustion chamber, and the overall combustion process is sustained. Due to the vertical, single-port, open-throat burner construction, and the radiant shielding by heat shield 21 of the control components which are housed within base unit 10 and sealed from the dusty environment by the elastic dust sealing ring 16, the present radiant space heater operates efficiently and reliably, with minimal maintenance required.

Although the above description provides many specificities, these enabling details should not be construed as limiting the scope of the invention, and it will be readily understood by those persons skilled in the art that the present invention is susceptible to many modifications, adaptations, and equivalent implementations without departing from this scope. For example: if a completely open bore through the length of the burner were desired, the extension of the web members 3 to the interior of the burner may be eliminated. The flame spreader could then be suspended from the combustion chamber or attached to an external portion of the web members. Different means could be used to attach the combustion chamber to the base unit, or the combustion chamber could be mounted to the burner which is mounted to the base unit, as long as the relative vertical distance between the base unit and the burner as well as between the burner and the combustion chamber may be adjusted during manufacture. Additionally, a means may be provided to adjust these distances after manufacture; for example, by providing several positions for attaching the combustion chamber and/or the base unit to the leg members 20. Generally, therefore, specific mechanical constructions may be a matter of choice but would not change the scope of the invention.

These and other changes can be made without departing from the spirit and the scope of the invention and without diminishing its attendant advantages. It is therefore intended that the present invention is not limited to the disclosed embodiments but should be defined in accordance with the claims which follow.

We claim:

1. A radiant heater comprising:

a combustion chamber having a closed top surface, a side wall surface having apertures, and a lower heat shield surface having an aperture;

a base unit including a top housing, said top housing having an aperture;

a fuel valve, disposed below said top housing, having an input port and an output port;

a fuel input tube having a fuel source input end and an opposite end attached to said input port;

a fuel output tube, having one end connected to said output port and an opposite fuel output orifice end, extending vertically through said aperture of said top housing with said fuel output orifice a predetermined distance above said base unit;

a burner having an open throat fuel input end and a single port flame-emanating end, said burner vertically adjustably mounted to said base unit, said fuel output orifice directed towards said fuel input end;

means for attaching said combustion chamber to said base unit at a predetermined height above said base unit, said combustion chamber positioned such that said flame-emanating end is directed towards said aperture of said heat shield surface;

means for ignition of fuel which flows through said burner, initiating combustion; and a control module for controlling combustion, including said ignition means and said fuel valve, said control module mounted to said base unit, below said top housing.

2. The radiant heater according to claim 1, wherein said burner has guide means for positioning said burner within said aperture of said heat shield surface.

3. The radiant heater according to claim 1, further comprising a means attachable to said burner for reducing the area of said single port flame emanating end.

4. The radiant heater according to claim 1, further comprising: a removable bottom cover attachable to said base unit; a spacing means for ensuring that said bottom cover does not touch said top housing when attached, forming a space therebetween; and an elastic sealing ring encompassing said space for preventing particulates from passing through said space.

5. The radiant heater according to claim 4, wherein said spacing means is same as said attachment means.

6. The radiant heater according to claim 1, further comprising a sleeve member having a nonconstant outer diameter, wherein said top housing has a noncircular aperture of dimension substantially close to that of said nonconstant outer diameter and through which said fuel input line extends axially, said sleeve member coaxially attached to said fuel input line and positioned within said noncircular aperture, thereby preventing axial rotation of fuel input line.

7. The radiant heater according to claim 1, wherein said control module is mounted to said base unit such that a space is formed between said base unit and said control module, thereby reducing heat transfer therebetween.

* * * * *